US006332971B1

(12) United States Patent
Hill

(10) Patent No.: US 6,332,971 B1
(45) Date of Patent: Dec. 25, 2001

(54) ELECTROCHEMICAL TREATMENT OF REINFORCED CONCRETE

(75) Inventor: Andrew Hill, Staveley (GB)

(73) Assignee: Atraverde Limited, Derbyshire (GB)

( * ) Notice: Subject to any disclaimer, the term of this patent is extended or adjusted under 35 U.S.C. 154(b) by 0 days.

(21) Appl. No.: 09/601,949

(22) PCT Filed: Feb. 4, 1999

(86) PCT No.: PCT/GB99/00359

§ 371 Date: Aug. 9, 2000

§ 102(e) Date: Aug. 9, 2000

(87) PCT Pub. No.: WO99/41427

PCT Pub. Date: Aug. 19, 1999

(30) Foreign Application Priority Data

Feb. 10, 1998 (GB) ..... 9802805

(51) Int. Cl.[7] ..... C23F 13/00

(52) U.S. Cl. ..... 205/734; 204/196.21; 204/196.36; 204/196.37

(58) Field of Search ..... 205/734; 204/196.01, 204/196.1, 196.36, 196.37, 196.21

(56) References Cited

U.S. PATENT DOCUMENTS

| | | | | |
|---|---|---|---|---|
| 5,183,694 | | 2/1993 | Webb | 428/67 |
| 6,165,346 | * | 12/2000 | Whitmore | 205/734 |
| 6,217,742 | * | 4/2001 | Bennett | 205/734 |

FOREIGN PATENT DOCUMENTS

| | | |
|---|---|---|
| 186334 | 7/1986 | (EP) . |
| 2309978 | 8/1997 | (GB) . |

OTHER PUBLICATIONS

Database WPI, Section Ch, Week 9012, Derwent Publications Ltd., London, GB; AN 90–088548; XP002090509 & JP 02/043385 A (Permelec Electrode Ltd), Feb. 13, 1990 (see Abstract).

* cited by examiner

*Primary Examiner*—Bruce F. Bell
(74) *Attorney, Agent, or Firm*—Caesar, Rivise, Bernstein, Cohen & Pokotilow, Ltd.

(57) ABSTRACT

Electric current of about 1 $A/M^2$ is applied to reinforcement in concrete and the gases released are allowed to pass to the atmosphere via gas permeable set material in a hole alongside the electrode.

15 Claims, 1 Drawing Sheet

ELECTROCHEMICAL TREATMENT OF REINFORCED CONCRETE

Figure 1:
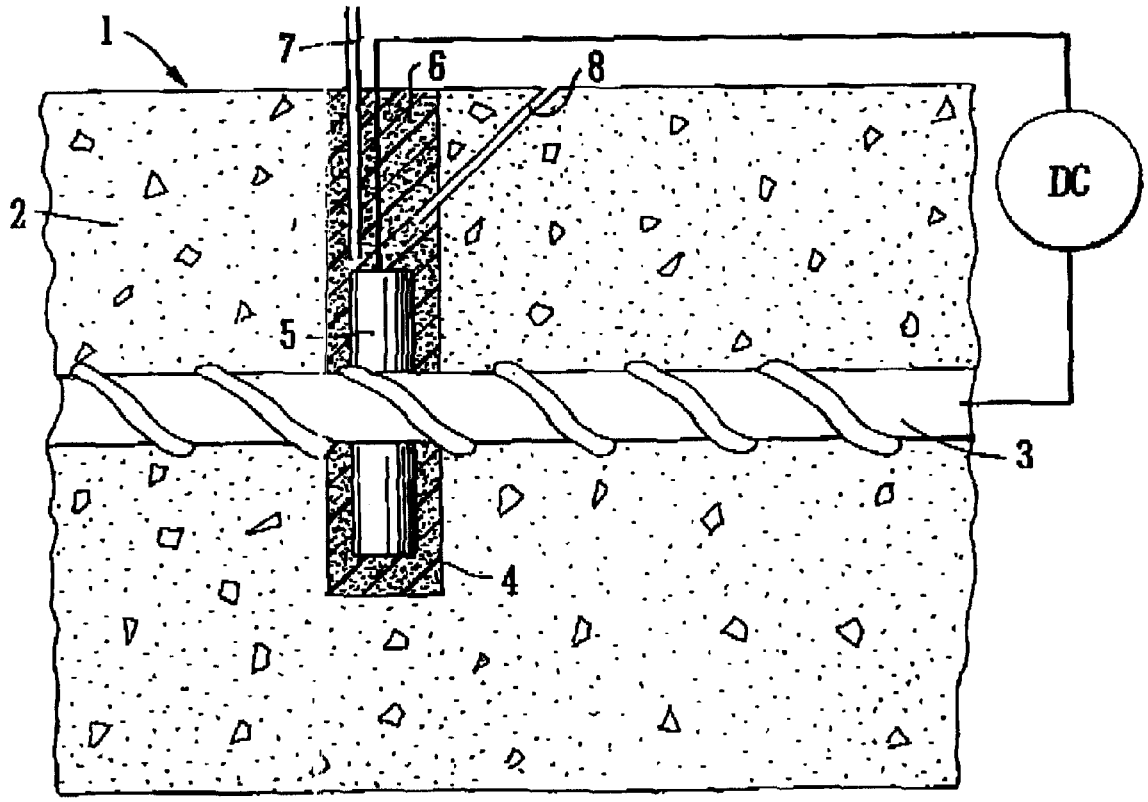

The invention relates to the electrochemical treatment of reinforced concrete and in particular to the protection of metal reinforcement in concrete, typically steel reinforcing bars, often called "rebars". It is well known that such rebars can suffer from corrosion, e.g. because of the presence of chloride salts or because of carbonation of the concrete. Cathodic protection is one way of protection against such corrosion or re-establishing the passivated layer on corroded rebar and involves passing a low voltage electrical current between the reinforcing bars as cathode and an electrode as anode. The anode may be permanent or sacrificial. Such a procedure tends to maintain the passivated coating on the rebar.

It has been realised that the current produces acid and gases at the anode. In traditional systems where the current density is low to control the acid generation, the gases can diffuse through the pores of the concrete to the atmosphere. However at higher current densities, often used in the application of "discrete" or "point" anodes where the gas generation is significantly higher from a small volume, then special anode designs are recommended.

In our EP-A-0186334 there is described and claimed a cathodic protection system in which an anode made of porous titanium suboxide is used. In our GB-A-2309978 we have described and claimed an electrode which is tubular and made of a porous titanium suboxide, arranged so that gases evolved in the electrochemical reactions can be conveyed away through the hollow electrode. There is however a need to convey gases where the electrode is made of a non-porous material, especially where high current densities are used and a considerable volume of gas is evolved. It is an object of this invention to satisfy this need. It is a further object to carry out the invention with a few electrodes as possible, ideally just one.

According to the invention in one aspect there is provided a method of cathodically protecting a concrete body containing metal reinforcement by applying a current between an electrode and the reinforcement so as to maintain the passivated layer on the reinforcement, the method comprising drilling a hole in the concrete from a surface thereof, the hole being of a cross-sectional shape and size similar to that of the electrode and to a depth to locate the electrode adjacent to, but not in physical contact with the reinforcement, and then filling the hole with gas permeable settable material, including the step of applying a current density at a level which in addition to cathodically protecting the reinforcement will cause the generation of gases, and allowing the gases released near the anode to reach the ambient atmosphere via the gas permeable set material.

According to the invention in another aspect there is provided a concrete structure having metal reinforcement therein, a hole extending from a surface of the concrete body and containing an electrode surrounded by gas permeable material, the electrode being formed of a non-porous material and arranged to carry current at a high current density.

The current density may range up to about 1 $A/m^2$ or higher if a suitable arrangement is adopted to manage the acid generation, such as a high alkali, low aggregate grout material. Higher current densities allow fewer electrodes to be employed and, subject to acceptable current distribution, the more cost effective the installation will be.

In an extreme case, where the porous material cannot release all the gas evolved at a suitable rate, a preformed duct may be present, extending from near the anode to the surface of the concrete. Preferably the duct comprises a hole cast into the set material used to backfill the hole when the electrode was inserted, or drilled into the concrete adjacent to the electrode to allow gases released in the electrochemical treatment to pass into the channel so provided from the pores in the concrete or the backfill material. The hole is typically 2–5 mm in diameter and extends to the depth of the electrode. If cast, it can be made by inserting a paper tube, such as a drinking straw, into the backfill material before it is set. Alternatively a porous tubular material can be inserted in the backfill material before it is set.

In order that the invention may be well understood it will now be described by way of example only with reference to the accompanying diagrammatic drawings, in which:

FIG. 1 is a vertical section through a concrete structure being treated according to the invention.

A concrete body 1, e.g. bridge deck is made of cast concrete 2 containing generally parallel lengths of reinforcing horizontal and/or vertical bars 3. When installed the bars have a passivated layer which protects them again corrosion; if the pH of the concrete changes, typically falling to a value of below 11=l , or in the presence of chloride or other contaminant ion, that layer may be attacked following which the bar corrodes and expands which causes the concrete to crack and break. When carrying out a remedial or preventative treatment at low current densities it is necessary to instal many electrodes and this involves much effort drilling holes. If a fewer number of electrodes are employed a higher current density is required which increases the rate of evolution of gases and creates the risk that the interface between the anode and the concrete is damaged and the current flow is hindered. If an electrical charge is applied to the bar the layer will be preserved. Such a current may be applied on a permanent basis, and this technique is called cathodic protection. Usually it is necessary to make many connections between electrodes and the bars, and this involves much effort in drilling holes for the many electrodes to reach the rebar. If one (or a few electrodes) are used cathodic protection may be carried out but a higher current density is required, (although it is within the scope of the invention to carry out temporary treatment, e.g. desalination or re-alkalisation). As a result of the electrochemical treatment gases are evolved, and if a high current density is used the rate of evolution of gases is high and can itself create the risk that the concrete will be damaged.

According to the invention, a hole 4 is drilled in the concrete to a depth to approach the reinforcement 3. The hole is typically 10–30 mm in diameter. An electrode 5 made of a suitably conductive and corrosion resistant material such as Magneli phase titanium suboxide, or titanium metal with a suitable coating of platinum, or of iridium oxide, or mixtures of iridium, tantalum and titanium oxides in various combinations, or niobium metal with or without such a coating, is inserted and the clearance is filled with a gas porous setting cementitious or resinous material 6, with or without a cast-in gas duct 7. A gas release hole 8 may be drilled adjacent to the electrode location. Once the backfill has cured, an anodic current is applied to the electrode at a current density of between 0.1 and 2 $A/m^2$ or higher, the gases evolved, e.g. chlorine, oxygen are released via the pores in the porous set material, or the cast-in gas duct, or the gas release hole.

What is claimed is:

1. A method for cathodically protecting a concrete body containing metal reinforcement, said method comprising the steps of:

(a) creating a hole of a predetermined diameter in the concrete body to a depth to approach the metal reinforcement;

(b) inserting an electrode comprising conductive and corrosion resistant material into said hole, said electrode being of a smaller diameter than said hole whereby an annular clearance is established;

(c) filling said clearance with a gas permeable material and allowing said gas permeable material to set;

(d) applying an electric current between said electrode and the reinforcement at a current density level selected such that the reinforcement is cathodically protected and allowing gases generated thereby to reach the ambient atmosphere via said gas permeable material.

2. The method of claim 1 further comprising the step of creating a passageway for the gases from said electrode to the ambient atmosphere.

3. The method of claim 2 wherein said gas passageway is formed in said gas permeable material.

4. The method of claim 3 wherein said step of creating a passageway in said gas permeable material comprises inserting a tube into said gas permeable material before said gas permeable material has set.

5. The method of claim 2 wherein said passageway is formed in the concrete body.

6. The method of claim 1 wherein said hole is approximately 10 to 30 mm in diameter.

7. The method of claim 1 wherein said current density level is of the order of 1 $A/m^2$.

8. The method of claim 1 wherein said electrode comprises a material selected from the group of Magneli phase titanium suboxide, or niobium metal.

9. The method of claim 1 wherein said electrode comprises titanium or niobium metal with a coating selected from the group of platinum, iridium oxide, or mixtures of iridium, tantalum or titanium oxides.

10. A concrete structure having a concrete body and metal reinforcement therein, said structure comprising:

a hole extending from a surface of the concrete body to a position adjacent the metal reinforcement;

said hole containing an electrode surrounded by a gas permeable material; and wherein said electrode comprises a non-porous, conductive and corrosion resistant material and is arranged to carry a current at a high current density.

11. The concrete structure of claim 10 further comprising a passageway in the concrete body, said passageway extending from said hole to the surface of the concrete body.

12. The concrete structure of claim 10 wherein said electrode is positioned at a depth in said hole and wherein said passageway extends from said depth in said hole to the surface of the concrete body.

13. The concrete structure of claim 10 further comprising a passageway in said gas permeable material that is set, said passageway in said set gas permeable material extending through said set gas permeable material to a position that is adjacent the surface of the concrete body.

14. The concrete structure of claim 13 wherein said passageway is approximately 2 to 5 mm in diameter.

15. The concrete structure of claim 13 wherein said electrode is positioned at a depth in said hole and wherein said passageway extends from said depth in said hole to said position that is adjacent the surface of the concrete body.

* * * * *

UNITED STATES PATENT AND TRADEMARK OFFICE

CERTIFICATE OF CORRECTION

PATENT NO. : 6,332,971 B1
DATED : December 25, 2001
INVENTOR(S) : Andrew Hill

It is certified that error appears in the above-identified patent and that said Letters Patent is hereby corrected as shown below:

Title page,
Item [73] Assignee, replace "Altaverde Limited" with -- Altaverda Limited --.

Signed and Sealed this

Twenty-first Day of May, 2002

*Attest:*

*Attesting Officer*

JAMES E. ROGAN
*Director of the United States Patent and Trademark Office*